US011817036B2

(12) United States Patent
Ko et al.

(10) Patent No.: US 11,817,036 B2
(45) Date of Patent: Nov. 14, 2023

(54) DISPLAY APPARATUS AND CONTROL METHOD THEREOF

(71) Applicant: SAMSUNG ELECTRONICS CO., LTD., Suwon-si (KR)

(72) Inventors: Suhong Ko, Suwon-si (KR); Sungho Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/838,996

(22) Filed: Jun. 13, 2022

(65) Prior Publication Data

US 2022/0392396 A1 Dec. 8, 2022

Related U.S. Application Data

(63) Continuation of application No. PCT/KR2022/005970, filed on Apr. 27, 2022.

(30) Foreign Application Priority Data

Jun. 7, 2021 (KR) ..... 10-2021-0073740

(51) Int. Cl.
*G09G 3/20* (2006.01)

(52) U.S. Cl.
CPC ..... *G09G 3/2096* (2013.01); *G09G 2310/04* (2013.01); *G09G 2340/16* (2013.01); *G09G 2354/00* (2013.01)

(58) Field of Classification Search
CPC ..... G09G 3/2096; G09G 2310/04; G09G 2340/16; G09G 2354/00; G09G 2340/0435; G09G 2360/18
See application file for complete search history.

(56) References Cited

U.S. PATENT DOCUMENTS

| | | | |
|---|---|---|---|
| 9,204,090 | B2 | 12/2015 | Kim et al. |
| 9,613,554 | B2 | 4/2017 | Jang et al. |
| 9,654,728 | B2 | 5/2017 | Kim et al. |
| 9,767,747 | B2 | 9/2017 | Oh et al. |
| 9,972,265 | B2 | 5/2018 | Na et al. |

(Continued)

FOREIGN PATENT DOCUMENTS

| | | | |
|---|---|---|---|
| JP | 2005-269016 | A | 9/2005 |
| KR | 10-0607264 | B1 | 7/2006 |

(Continued)

OTHER PUBLICATIONS

International Search Report and Written Opinion (PCT/ISA/210, PCT/ISA/237) dated Aug. 19, 2022 by the International Searching Authority in International Application No. PCT/KR2022/005970.

*Primary Examiner* — Antonio Xavier
(74) *Attorney, Agent, or Firm* — Sughrue Mion, PLLC

(57) ABSTRACT

A display apparatus is provided. The display apparatus includes a memory configured to store an input image, a display panel comprising a plurality of gate lines and a plurality of data lines, and a processor configured to control the display panel to output an entire area of a first frame of a plurality of frames included in the input image by controlling the plurality of gate lines and the plurality of data lines, and control the display panel to output a partial area of a second frame subsequent to the first frame by controlling some of the plurality of gate lines and the plurality of data lines.

14 Claims, 8 Drawing Sheets

(56) References Cited

U.S. PATENT DOCUMENTS

| | | | | |
|---|---|---|---|---|
| 10,075,673 | B2 | 9/2018 | Kim et al. | |
| 10,504,442 | B2 | 12/2019 | Yoo | |
| 10,944,975 | B2 | 3/2021 | Nakagami | |
| 11,341,928 | B2 | 5/2022 | Lee et al. | |
| 2002/0036717 | A1* | 3/2002 | Abiko | H04N 19/577 375/E7.25 |
| 2003/0184826 | A1* | 10/2003 | Takemoto | H04N 21/4117 348/E5.073 |
| 2010/0231800 | A1 | 9/2010 | White et al. | |
| 2011/0032231 | A1* | 2/2011 | Maruyama | G09G 3/2096 345/208 |
| 2014/0022329 | A1 | 1/2014 | Kim et al. | |
| 2014/0085276 | A1 | 3/2014 | Jang et al. | |
| 2016/0035297 | A1 | 2/2016 | Oh et al. | |
| 2016/0065893 | A1 | 3/2016 | Kim et al. | |
| 2016/0111055 | A1 | 4/2016 | Na et al. | |
| 2017/0223311 | A1 | 8/2017 | Kim et al. | |
| 2018/0342192 | A1* | 11/2018 | Lee | G09G 3/2007 |
| 2019/0005884 | A1 | 1/2019 | Yoo | |
| 2019/0141287 | A1 | 5/2019 | Shoa Hassani Lashdan et al. | |
| 2019/0206329 | A1* | 7/2019 | Lee | G09G 3/3677 |
| 2019/0341007 | A1* | 11/2019 | Holland | G06F 3/1415 |
| 2021/0295794 | A1 | 9/2021 | Lee et al. | |

FOREIGN PATENT DOCUMENTS

| | | | |
|---|---|---|---|
| KR | 10-2014-0011264 | A | 1/2014 |
| KR | 10-2014-0039524 | A | 4/2014 |
| KR | 10-1481541 | B1 | 1/2015 |
| KR | 10-2015-0069994 | A | 6/2015 |
| KR | 10-1539028 | B1 | 7/2015 |
| KR | 10-2016-0045215 | A | 4/2016 |
| KR | 10-2019-0003334 | A | 1/2019 |
| KR | 10-2020-0011777 | A | 2/2020 |
| WO | 2018/135321 | A1 | 7/2018 |

* cited by examiner

DISPLAY APPARATUS AND CONTROL METHOD THEREOF

CROSS-REFERENCE TO RELATED APPLICATION(S)

This application is a bypass continuation of International Application No. PCT/KR2022/005970, filed on Apr. 27, 2022, which is based on and claims priority to Korean Patent Application No. 10-2021-0073740, filed on Jun. 7, 2021, in the Korean Intellectual Property Office, the disclosures of which are incorporated by reference herein in their entireties.

BACKGROUND

Field

Example embodiments of the disclosure relate to a display apparatus and a control method thereof and more particularly relates to a display apparatus which displays an input image and a control method thereof.

Description of Related Art

Along with development of imaging equipment, high-quality contents are provided. Particularly, in recent years, contents having a frame rate of 120 Hz or higher are provided.

In a case of reproducing such contents, a content may be displayed at the frame rate of the content as it is, when an operation frequency of a display apparatus is 120 Hz or higher, but most of the display apparatuses of the related art had the operation frequency of 60 Hz or lower.

In this case, the display apparatus operates the content of 120 Hz at 60 Hz by using a method for skipping some frames. In this case, there is a problem that the content is not smoothly reproduced.

SUMMARY

According to an aspect of an example embodiment of the disclosure, there is provided a display apparatus including a memory configured to store an input image, a display panel including a plurality of gate lines and a plurality of data lines, and a processor configured to control the display panel to output an entire area of a first frame of a plurality of frames included in the input image by controlling the plurality of gate lines and the plurality of data lines, and control the display panel to output a partial area of a second frame subsequent to the first frame by controlling some of the plurality of gate lines and the plurality of data lines. An output frequency of the first frame may be different from an output frequency of the second frame.

According to an aspect of an example embodiment of the disclosure, there is provided a method for controlling a display apparatus, the method including controlling a display panel to output an entire area of a first frame of a plurality of frames included in an input image by controlling a plurality of gate lines and a plurality of data lines included in the display panel, and controlling the display panel to output a partial area of a second frame subsequent to the first frame by controlling some of the plurality of gate lines and the plurality of data lines. an output frequency of the first frame may be different from an output frequency of the second frame.

BRIEF DESCRIPTION OF THE DRAWINGS

The above and other aspects, features, and advantages of certain example embodiments of the disclosure will be more apparent from the following description taken in conjunction with the accompanying drawings, in which.

DETAILED DESCRIPTION

Figure 1:
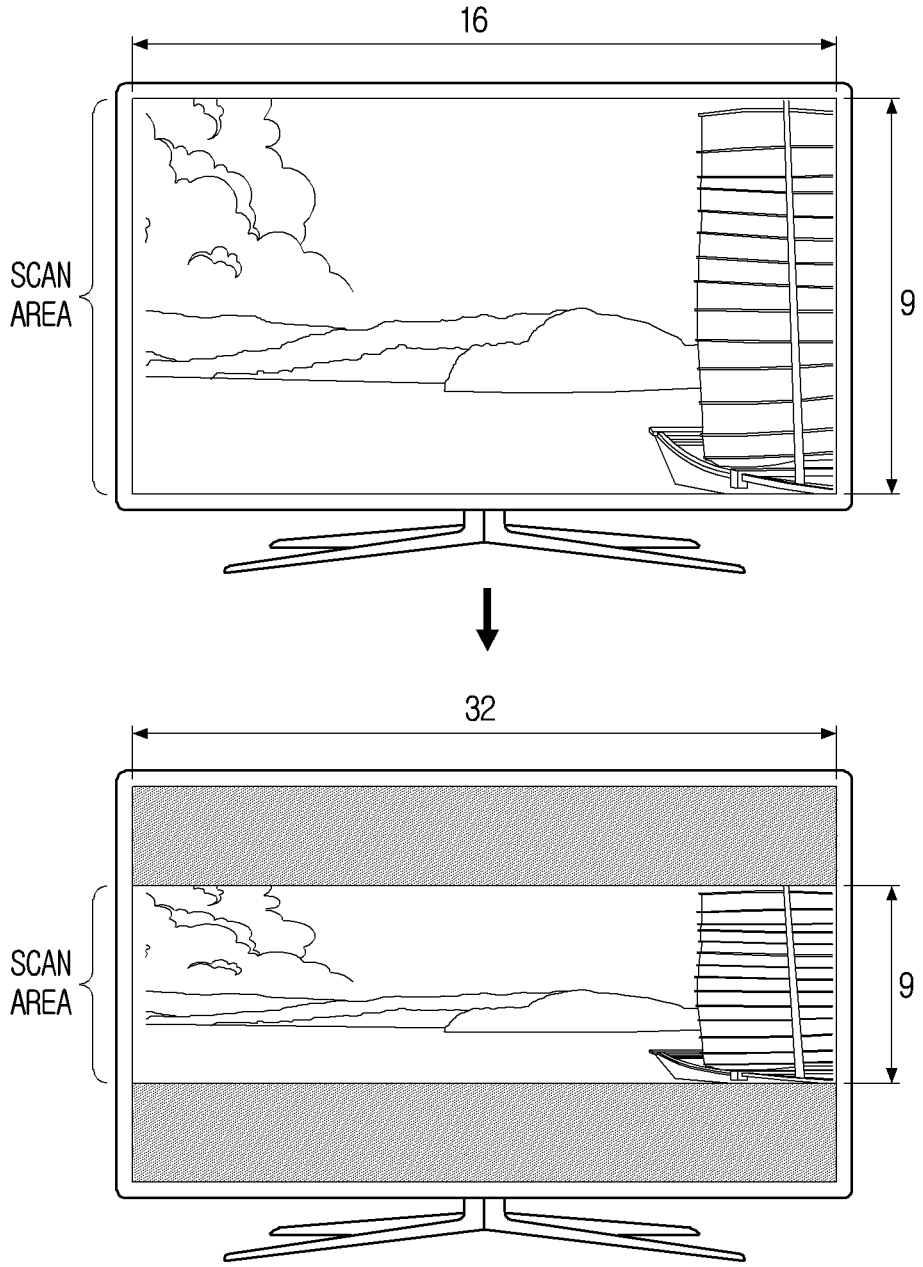
FIG. 1 is a diagram illustrating an example of reproducing content by limiting a gate scan area.

The example embodiments of the disclosure may be diversely modified. Accordingly, example embodiments are illustrated in the drawings and are described in detail in the detailed description. However, it is to be understood that the disclosure is not limited to the example embodiment described herein, but includes all modifications, equivalents, and substitutions without departing from the scope and spirit of the disclosure. Also, well-known functions or constructions are not described in detail since they would obscure the disclosure with unnecessary detail.

Hereinafter, the disclosure will be described in detail with reference to the accompanying drawings.

The disclosure is made in view of the above needs and an object of the disclosure is to provide a display apparatus for outputting an input image at a frame rate higher than an operation frequency of the display apparatus and a control method thereof.

The terms used in embodiments of the disclosure have been selected as widely used general terms as possible in consideration of functions in the disclosure, but these may vary in accordance with the intention of those skilled in the art, the precedent, the emergence of new technologies and the like. In addition, in a certain case, there may also be an arbitrarily selected term, in which case the meaning will be described in the description of the disclosure. Therefore, the terms used in the disclosure should be defined based on the meanings of the terms themselves and the contents throughout the disclosure, rather than the simple names of the terms.

In this disclosure, the terms such as "comprise", "may comprise", "consist of", or "may consist of" are used herein to designate a presence of corresponding features (e.g., constituent elements such as number, function, operation, or part), and not to preclude a presence of additional features.

It should be understood that the expression such as "at least one of A or/and B" expresses any one of "A", "B", or "at least one of A and B".

The expressions "first," "second" and the like used in the disclosure may denote various elements, regardless of order and/or importance, and may be used to distinguish one element from another, and does not limit the elements.

Unless otherwise defined specifically, a singular expression may encompass a plural expression. It is to be understood that the terms such as "comprise" or "consist of" are used herein to designate a presence of characteristic, number, step, operation, element, part, or a combination thereof, and not to preclude a presence or a possibility of adding one or more of other characteristics, numbers, steps, operations, elements, parts or a combination thereof.

In this disclosure, a term "user" may refer to a person using an electronic apparatus or an apparatus using an electronic apparatus (e.g., an artificial intelligence electronic apparatus).

Hereinafter, various example embodiments of the disclosure will be described in more detail with reference to the accompanying drawings.

FIG. 1 is a diagram illustrating an example of reproducing content by limiting a gate scan area. Referring to FIG. 1, by using a method of limiting the gate scan area, a display apparatus capable of outputting an 8K4K image at 120 Hz having an aspect ratio of 16:9, referring to an upper part of FIG. 1, may output an image at 240 Hz by processing the 8K4K image to an 8K2K image having an aspect ratio of 32:9, referring to a lower part of FIG. 1. However, in this case, there is a problem that not all of an entire area of the display is used.

Figure 2:
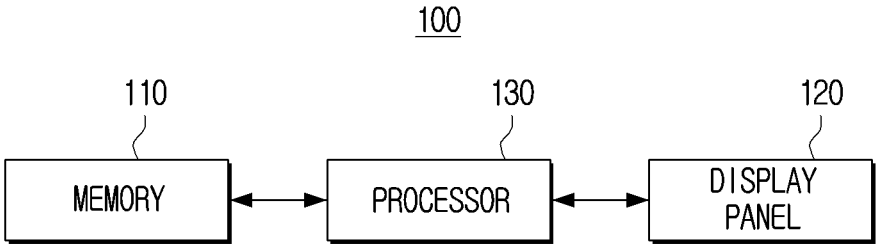
FIG. 2 is a block diagram illustrating a configuration of a display apparatus according to an example embodiment.

FIG. 2 is a block diagram illustrating a configuration of a display apparatus according to an example embodiment.

A display apparatus 100 is an apparatus which displays an input image and may be a TV, a desktop PC, a notebook, a video wall, a large format display (LFD), a digital signage, a digital information display (DID), a projector display, a digital video disk (DVD) player, a refrigerator, a washing machine, a smartphone, a table PC, a monitor, smart glasses, a smart watch, or the like, and may be any apparatus as long as the apparatus is able to display an input image.

Referring to FIG. 2, the display apparatus 100 may include a memory 110, a display panel 120, and a processor 130. However, there is no limitation thereto, and the display apparatus 100 may be implemented without including some constituent elements or may be implemented by further including other constituent elements.

The memory 110 may be referred to as hardware storing information such as data in an electrical or magnetic manner such that the processor 130 or the like is able to access the information. The memory 110 may be implemented as at least one hardware among a non-volatile memory, a volatile memory, a flash memory, a hard disk drive (HDD) or a solid state drive (SSD), a RAM, a ROM, and the like.

The memory 110 may store at least one instruction or module related to the operation of the processor 130. Here, the instruction may be a symbol unit for instructing the operation of the processor 130 and may be written in a machine language which is a language that a computer is able to understand. The module may be a series of instruction set for performing a specific job in a job unit.

The memory 110 may store data which is information in a bit or bite unit that is able to represent a character, a number, an image, or the like. For example, the memory 110 may store an input image.

The memory 110 may be accessed by the processor 130 and reading, recording, editing, deleting, and/or updating of the instruction, the module, and/or the data by the processor 130 may be performed.

The display panel 120 may include a plurality of pixels and display an image signal. For example, the display panel 120 may include a plurality of pixels of 7680×4320, if it is implemented with 8 k resolution. Alternatively, the display panel 120 may include a plurality of pixels of 3840×2160, if it is implemented with 4 k resolution. However, there is no limitation thereto, and the display panel 120 may be implemented with various resolutions. In addition, an aspect ratio of the display panel 120 may be variously changed according to an embodiment.

Each of the plurality of pixels included in the display panel 120 may be configured with sub-pixels representing red (R), green (G), and blue (B). In another example, the pixel may be configured with sub-pixels representing W, in addition to RGB. However, there is no limitation thereto, and each of the plurality of pixels may be implemented in various forms.

The display panel 120 may include a plurality of gate lines and a plurality of data lines. The gate line may be a line for transmitting a scan signal or a gate signal and the data line may be a line for transmitting a data voltage. For example, each of the plurality of sub-pixels included in the display panel 120 may be connected to one gate line and one data line. Particularly, the plurality of data lines may provide data to the pixels in the same row, respectively. In other words, the display panel 120 may be a panel having a 1D1G stripe structure. However, there is no limitation thereto, and the display panel 120 may be implemented in various forms.

The display panel 120 may drive the plurality of gate lines sequentially or may drive only some gate lines. For example, the display panel 120 may drive all of 4320 gate lines sequentially or may drive only 2160 gate lines sequentially among the 4320 gate lines. In addition, the display panel 120 may drive all gate lines of 4320 gate lines or drive only some gate lines according to a frame.

The display panel 120 may drive a frame having a first resolution at a first frame rate. The first frame rate herein may be a maximum frame rate outputable by the display panel 120. Hereinafter, for convenience of description, an operation frequency and the first frame rate of the display panel 120 will be interchangeably used.

The display panel 120 may be controlled to display one frame during a first time corresponding to the first frame rate. For example, the display panel 120 may display one frame during 1/60 s. If the display panel 120 is a 60 Hz panel having a resolution of 7680×4320, the display panel 120 may display one frame having a resolution of 7680×4320 during 1/60 s on a display panel formed of 7680×4320 pixels, and if the display panel 120 is a 60 Hz panel having a resolution of 3840×2160, the display panel 120 may display one frame having a resolution of 3840×2160 during 1/60 son a display panel formed of 3840×2160 pixels.

The first time may be a time taken for all of the plurality of gate lines included in the display panel 120 to be driven sequentially. For example, if the display panel 120 is a 60 Hz panel having a resolution of 7680×4320, the display panel 120 may drive gate lines corresponding to 7680 pixels included in a first line, drive gate lines corresponding to 7680 pixels included in a second line sequentially, and finally drive gate lines corresponding to 7680 pixels included in a $4320^{th}$ line. One frame is displayed through such an operation, and the time for displaying the one frame may refer to a time during which all gate lines included in the first line to the $4320^{th}$ line are driven.

Alternatively, the display panel 120 may display only a partial area of one frame by sequentially driving only some gate lines among the plurality of gate lines. For example, if the display panel 120 is a 60 Hz panel having a resolution of 7680×4320 and only 2160 gate lines among the 4320 gate lines are driven, only an area of 7680×2160 may be displayed on one frame having the resolution of 7680×4320.

Hereinabove, it is described that the display panel 120 is a 60 Hz panel having a resolution of 7680×4320, but this is merely an embodiment, and any display panel 120 may be used, as long as the display panel 120 is able to drive only some gate lines among a plurality of gate lines.

The display panel 120 may be implemented in various forms such as a liquid crystal display (LCD), an organic light emitting diodes (OLED) display, a plasma display panel (PDP), a micro LED, a laser display, virtual reality (VR) glass, and the like. The display panel 120 may also include a driving circuit or a backlight unit which may be implemented in a form of a-si TFT, a low temperature poly silicon (LTPS) TFT, or an organic TFT (OTFT). The display panel 120 may be implemented as a touch screen combined with a touch sensor, a flexible display, a 3D display, or the like.

The processor 130 may generally control the operation of the display apparatus 100. Specifically, the processor 130 may be connected to each constituent element of the display apparatus 100 and generally control the operation of the display apparatus 100. For example, the processor 130 may be connected to the constituent elements such as the memory 110, the display panel 120, and the like to control the operation of the display apparatus 100. In addition, the processor 130 may include an image processing unit (scaler, not illustrated) and a timing controller (TCON, not illustrated). Alternatively, the image processing unit and the timing controller may be implemented as separate constituent elements, and in this case, the processor 130 may be connected to the constituent elements such as the image processing unit, the timing controller, and the like to control the operation of the display apparatus 100.

According to an embodiment, the processor 130 may be implemented as a digital signal processor (DSP), a microprocessor, or a time controller (TCON). However, there is no limitation thereto, and the processor 130 may include one or more of a central processing unit (CPU), a microcontroller unit (MCU), a microprocessing unit (MPU), a controller, an application processor (AP), or a communication processor (CP), and an ARM processor or may be defined as the corresponding term. In addition, the processor 130 may be implemented as a System on Chip (SoC) or a large scale integration (LSI) including the processing algorithm or may be implemented in form of a field programmable gate array (FPGA).

The processor 130 may control the display panel 120 to control the plurality of gate lines and the plurality of data lines to output the entire area of a first frame among a plurality of frames included in the input image, and control the display panel 120 to control some of the plurality of gate lines and the plurality of data lines to output a partial area of the second frame subsequent to the first frame.

For example, if the display panel 120 is a 60 Hz panel having a resolution of 7680×4320, the processor 130 may control the display panel 120 to control 4320 gate lines and 7680 data lines to output the entire area of the first frame among the plurality of frames included in the input image, and control the display panel 120 to control 2160 gate lines among 4320 gate lines and 7680 data lines to output a partial area of the second frame subsequent to the first frame. In this case, the first frame may be output during 1/60 s, since all of the 4320 gate lines are driven, but the second frame may be output during 1/120 s, since only 2160 gate lines are driven. If the display apparatus 100 outputs a plurality of first frames, 60 first frames may be output during 1 second and the input image may be output at 60 Hz, and if the display apparatus 100 outputs a plurality of second frames, 120 second frames may be output during 1 second and the input image may be output at 120 Hz. In other words, the output of only a partial area of the frame enables high-speed driving. Herein, the input image may be an image having a frame rate higher than an output frequency of the display panel 120.

The processor 130 may control the display panel 120 by providing a turn-on signal to only some of the plurality of gate lines while the partial area of the second frame is output through a partial area of the display panel 120. The processor 130 may control the display panel 120 to output the partial area of the second frame by providing image data of the second frame corresponding to the gate lines to which the turn-on signal is provided, to the plurality of data lines.

For example, if the display panel 120 is a panel having a resolution of 7680×4320, the input image is an image having a resolution of 7680×4320, and the partial area of the second frame is an area having a resolution of 7680×2160 on a lower end of the frame, the processor 130 may control the display panel 120 to sequentially drive a $2161^{st}$ gate line to a $4320^{th}$ gate line, among the 4320 gate lines. The processor 130 may control the display panel 120 such that data on a $2161^{th}$ row to data on a $4320^{th}$ row of the second frame are input to the plurality of data lines.

The processor 130 may control the display panel 120 in a manner such that, while the partial area of the second frame is output through the partial area of the display panel 120, an image corresponding to the first frame is output to a remaining area, other than the partial area, of the display panel 120.

In the above example, a first gate line to a $2160^{th}$ gate line from the upper end of the 4320 gate lines are not driven while the second frame is output, and accordingly, the data of the first frame before outputting the second frame may be maintained in an area corresponding to the first gate line to the $2160^{th}$ gate line.

Alternatively, if a horizontal resolution of the partial area of the second frame is less than a horizontal resolution of the display panel 120, the processor 130 may control the display panel 120 to output the partial area of the first frame and the partial area of the second frame by providing, to the plurality of data lines, a part of the image data of the first frame and a part of the image data of the second frame corresponding to the gate lines, to which the turn-on signal is provided.

Such an operation may be performed because, if the turn-on signal is provided to some gate lines, data of all data lines corresponding to the gate lines, to which the turn-on signal is provided, is output. In this case, an outer area other than the partial area of the second frame may be output, and in order to solve such a problem, the data lines may be controlled such that the partial area of the first frame is output in the outer area other than the partial area of the second frame. This will be described in detail with reference to FIG. 6.

The processor 130 may identify at least one scene from the input image, identify a frame at a predetermined interval among frames corresponding to each of the at least one scene as the first frame, and identify the others frame among the frames corresponding to each of the at least one scene as the second frames.

However, there is no limitation thereto, and the processor 130 may identify an intra-frame as the first frame and identify an inter-frame as the second frame. Alternatively, the processor 130 may identify a frame at a predetermined interval among the plurality of frames of the input image as the first frame and identify the other frames, other than the identified first frame(s) among the plurality of frames of the input image, as the second frames.

Alternatively, the processor 130 may identify a plurality of frames in which a camera angle is fixed from the input image, identify a frame at a predetermined interval among the plurality of identified frames as the first frame, and identify the other frames, other than the identified first frame(s) among the plurality of identified frames, as the second frames.

The processor 130 may identify the partial area of the second frame based on a motion value of each frame in each of the at least one scene. For example, the processor 130 may obtain motion values of all pixels in each frame and identify a partial area based on a point with a maximum motion value. The processor 130 may identify a partial area (e.g., square area) having a predetermined size based on the point with the maximum motion value as the partial area.

However, there is no limitation thereto, and the processor 130 may obtain motion values of a plurality of predetermined points in each frame. Alternatively, the processor 130 may identify the partial area based on the plurality of points having the motion value equal to or more than a predetermined value, or the processor 130 may identify the partial area by various other methods. Alternatively, the display apparatus 100 may further include a user interface (not illustrated) and the processor 130 may identify the partial area based on a user command received through the user interface.

The processor 130 may identify the size of the partial area of the second frame based on the number of first frames included in each of the at least one scene. For example, it is assumed that the input image includes 60 frames, the number of the first frame among the 60 frames is one, the remaining frames are second frames, the first frame is output during $1/60$ s, and the partial area of the second frame is output during $1/120$ s. In this case, a delay of $1/120$ s occurs due to the first frame. In other words, although the input image needs to be output during 1 s, the first frame is output during $1/60$ s ($=2/120$ s), and accordingly, the input image is output during $1+1/120$ s. In order to solve the problem of occurrence of the delay, the processor 130 may reduce the size of the partial area to reduce the time during which the partial area of the second frame is output to be shorter than $1/120$ s. Ideally, the processor 130 may identify the size of the partial area such that a reproduction time of the input image is not changed.

However, there is no limitation thereto, and the processor 130 may remove some of the plurality of second frames based on the number of first frames included in each of the at least one scene. In a case of the example described above, since the time for outputting one of the partial area of the second frame is $1/120$ s, the processor 130 may not output one of the second frame to compensate the delay of $1/120$ s that may otherwise occur due to the output of the one first frame. Alternatively, if the number of first frames among the 60 frames is two, the processor 130 may not output two second frames to compensate the delay of $2/120$ s that may otherwise occur due to the output of the two first frames.

As described above, it is possible to provide enhanced response characteristics to the user through high-speed driving of the display apparatus 100.

Figure 3:
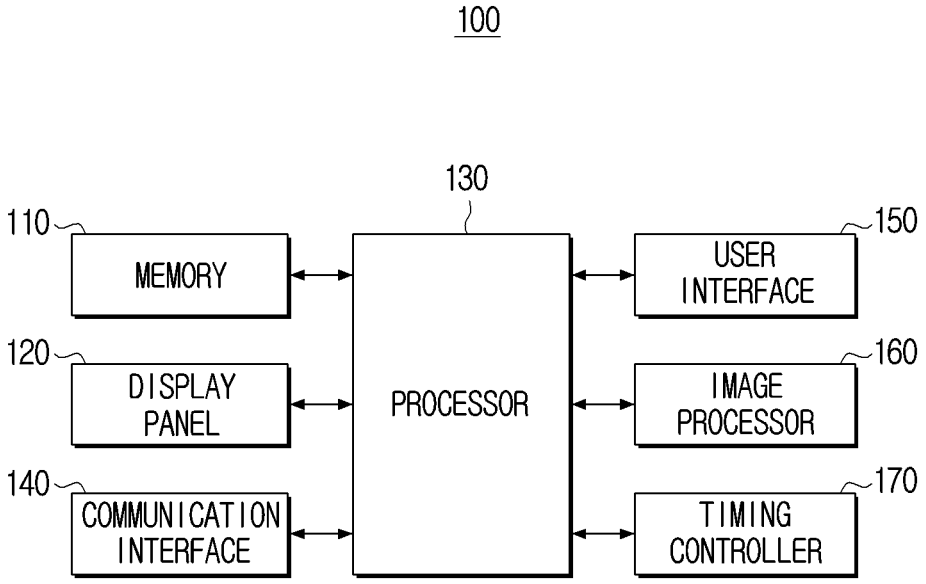
FIG. 3 is a diagram illustrating a configuration of the display apparatus according to an example embodiment.

FIG. 3 is a diagram illustrating a configuration of the display apparatus according to an example embodiment.

Referring to FIG. 3, the display apparatus 100 may further include a communication interface 140, a user interface 150, an image processor 160, and a timing controller 170, in addition to the memory 110, the display panel 120, and the processor 130 as shown in FIG. 2. The description of the constituent elements of FIG. 3 which are overlapped with the constituent elements of FIG. 2 will not be repeated. FIG. 3 illustrates an apparatus in which the image processor 160 and the timing controller 170 are implemented separately from the processor 130. In this case, the processor 130 may perform image processing by controlling the image processor 160 and the timing controller 170.

The communication interface 140 may be a constituent element which communicates with various types of external apparatuses according to various types of communication methods. For example, the display apparatus 100 may receive the input image and the like from the external apparatus through the communication interface 140.

The communication interface 140 may include a Wi-Fi module, a Bluetooth module, an infrared communication module, a wireless communication module, and the like. Here, each communication module may be implemented in a form of at least one hardware chip.

The Wi-Fi module and the Bluetooth module may communicate by a Wi-Fi method and a Bluetooth method, respectively. In a case of using the Wi-Fi module or the Bluetooth module, various pieces of connection information such as a service set identifier (SSID) or a session key may be transmitted or received first to allow the communication connection by using the connection information, and then various pieces of information may be transmitted and received based on the communication connection. The infrared communication module may perform communication according to a technology of infrared communication (e.g., infrared Data Association (IrDA)) for transmitting data in a close range wirelessly by using infrared rays between visible rays and millimeter waves.

The wireless communication module may include at least one communication chip for performing communication according to various wireless communication standard such as Zigbee, 3rd Generation (3G), 3rd Generation Partnership Project (3GPP), Long Term Evolution (LTE), LTE Advanced (LTE-A), 4th Generation (4G), 5th Generation (5G), and the like, in addition to the above communication method.

The communication interface 140 may include a wired communication interface such as a high-definition multimedia interface (HDMI), a DisplayPort (DP), a Thunderbolt, a universal serial bus (USB), an RGB, a D-subminiature (D-SUB), a digital visual interface (DVI), or the like.

In addition, the communication interface 140 may include at least one of wired communication modules for performing communication by using a local area network (LAN) module, an Ethernet module, pair cables, a coaxial cable, an optical fiber cable, and the like.

The user interface 150 may be implemented as a button, a touch pad, a mouse, and a keyboard, and may also be implemented as a touch screen capable of performing the display function and the manipulation input function. The button may be various types of buttons such as a mechanical button, a touch pad, or a wheel formed in any area of a front portion, a side portion, or a rear portion of appearance of a main body of the display apparatus 100.

The display apparatus 100 may further include a microphone (not illustrated) and receive a user's voice through the microphone. The display apparatus 100 may digitize the user's voice received through the microphone and perform a corresponding operation based on the digitized user's voice. Alternatively, the display apparatus 100 may receive the user's voice input by a separate apparatus such as a remote control apparatus (not illustrated) from the corresponding apparatus.

The remote control apparatus herein may be an apparatus manufactured to control the display apparatus 100. However, there is no limitation thereto and the remote control apparatus may be an apparatus obtained by installing an application for controlling the display apparatus 100 on an apparatus such as a smartphone.

In this case, the display apparatus 100 may include an IR receiver and receive a control signal from the remote control apparatus through the IR receiver. However, there is no limitation thereto and the display apparatus 100 may receive a control signal from the remote control apparatus through Bluetooth, Wi-Fi, or the like, and any communication standard may be used as long as the communication standard is capable of receiving a controls signal from the remote control apparatus.

The remote control apparatus may include a microphone for receiving a user's voice and a communicator for digitizing the received user's voice and transmitting the digitized user's voice to the display apparatus 100.

Here, the processor 130 may identify the digitized user's voice directly or may transmit to an external server such as a speech-to-text (STT) server and receive a corresponding control command from the external server.

The image processor 160 may process the input image. For example, the image processor 160 may decode the input image.

The timing controller 170 may receive an input signal IS, a horizontal synchronization signal Hsync, a vertical synchronization signal Vsync, a main clock signal MCLK, and the like from the processor 130, generate an image data signal, a scan control signal, a data control signal, a light emitting control signal, and the like and provide these signals to the display panel 120.

Hereinabove, it is described that the image processor 160 and the timing controller 170 are implemented separately, but it is not limited thereto. For example, at least a part of the image processor 160 or the timing controller 170 may be implemented as one constituent element. In addition, at least a part of the image processor 160 or the timing controller 170 may be implemented as one constituent element of the display panel 120 or the processor 130.

Figure 4:
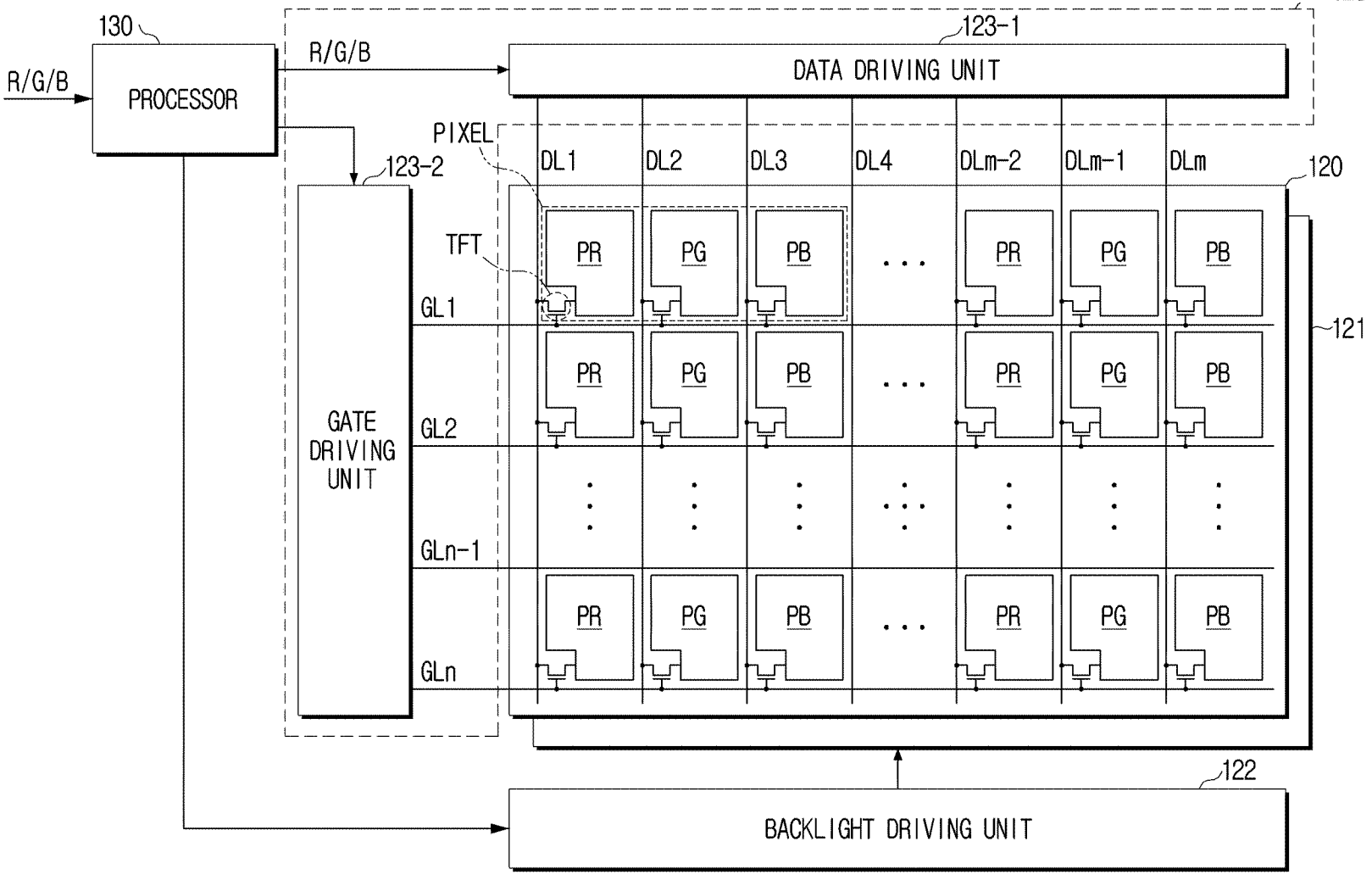
FIG. 4 is a diagram illustrating a structure of a display panel according to an example embodiment.

FIG. 4 is a diagram illustrating a structure of the display panel 120 according to an embodiment.

The display panel 120 may be formed such that gate lines GL1 to GLn and data lines DL1 to DLm intersect with each other and R, G, and B sub-pixels PR, PG, and PB may be formed in areas provided based on the intersection. The adjacent R, G, and B sub-pixels PR, PG, and PB form one pixel. In other words, each pixel may include the R sub-pixel PR for displaying red color (R), the G sub-pixel PG for displaying green color (G), and the B sub-pixel PB for displaying blue color (B) and reproduce colors of a subject with three primary colors of red (R), green (G), and blue (B).

In a case where the display panel 120 is implemented as an LCD panel, each of the sub-pixels PR, PG, and PB may include a pixel electrode and a common electrode and light transmittance changes with change of liquid crystal arrangement in an electrical field formed with a phase difference between both electrodes. TFTs formed in the intersection of the gate lines GL1 to GLn and the data lines DL1 to DLm may supply video data, that is, red (R), green (G), and blue (B) data from the data lines DL1 to DLm to the pixel electrode of each of the sub-pixels PR, PG, and PB in response to a scan pulse from each of the gate lines GL1 to GLn.

The display panel 120 may further include a backlight unit 121, a backlight driving unit 122, and a panel driving unit 123.

The backlight driving unit 122 may be implemented in a form of including a driver IC for driving the backlight unit 121. According to an example, the driver IC may be implemented as hardware separate from the processor 130. For example, in a case where light sources included in the backlight unit 121 are implemented as LED elements, the driver IC is implemented as at least one LED driver for controlling a current applied to the LED element. According to an embodiment, the LED driver may be disposed at a rear end of a power supply (e.g., switching mode power supply (SMPS)) to receive a voltage from the power supply. However, according to another embodiment, the LED driver may receive a voltage from a separate power device. Alternatively, the SMPS and the LED driver may be implemented in a form of one integrated module.

The panel driving unit 123 may be implemented to include a driver IC for driving the display panel 120. According to an example, the driver IC may be implemented as hardware separated from the processor 130. For example, the panel driving unit 123 may include a data driving unit 123-1 for supplying video data to data lines, and a gate driving unit 123-2 for supplying a scan pulse to gate lines.

The data driving unit 123-1 generates a data signal and generates a data signal by receiving image data having R/G/B components from the processor 130 or the timing controller. In addition, the data driving unit 123-1 may be connected to data lines DL1, DL2, DL3, . . . , DLm of the display panel 120 to apply a generated data signal to the display panel 120.

The gate driving unit 123-2 (or scan driving unit) generates a gate signal (or scan signal) and is connected to gate lines GL1, GL2, GL3, . . . , GLn to transfer a gate signal to a specific line of the display panel 120. A data signal output from the data driving unit 123-1 may be transferred to a pixel to which the gate signal is transferred.

The processor 130 may control the gate driving unit 123-2 to drive some of the plurality of gate lines. In this case, the remaining lines of the plurality of gate lines may not be driven. Through such an operation, only the partial area of the frame may be displayed, and this leads to reduction of time for outputting the frame, thereby displaying an input image at a frame rate higher than an operation frequency of the display panel 120.

As described above, the display apparatus 100 may perform high-speed driving by driving only some of the plurality of gate lines and outputting the partial area of the frame.

Figure 5:
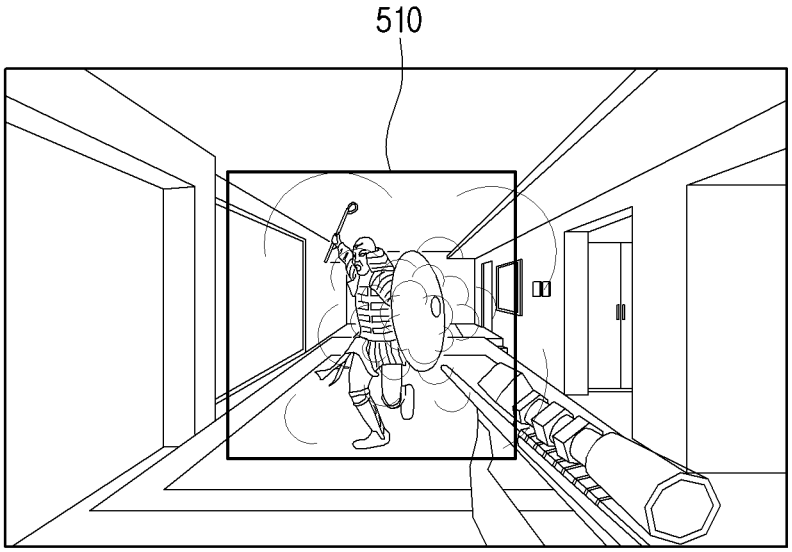
FIG. 5 is a diagram illustrating a partial area of a second frame according to an example embodiment.
Figure 6:
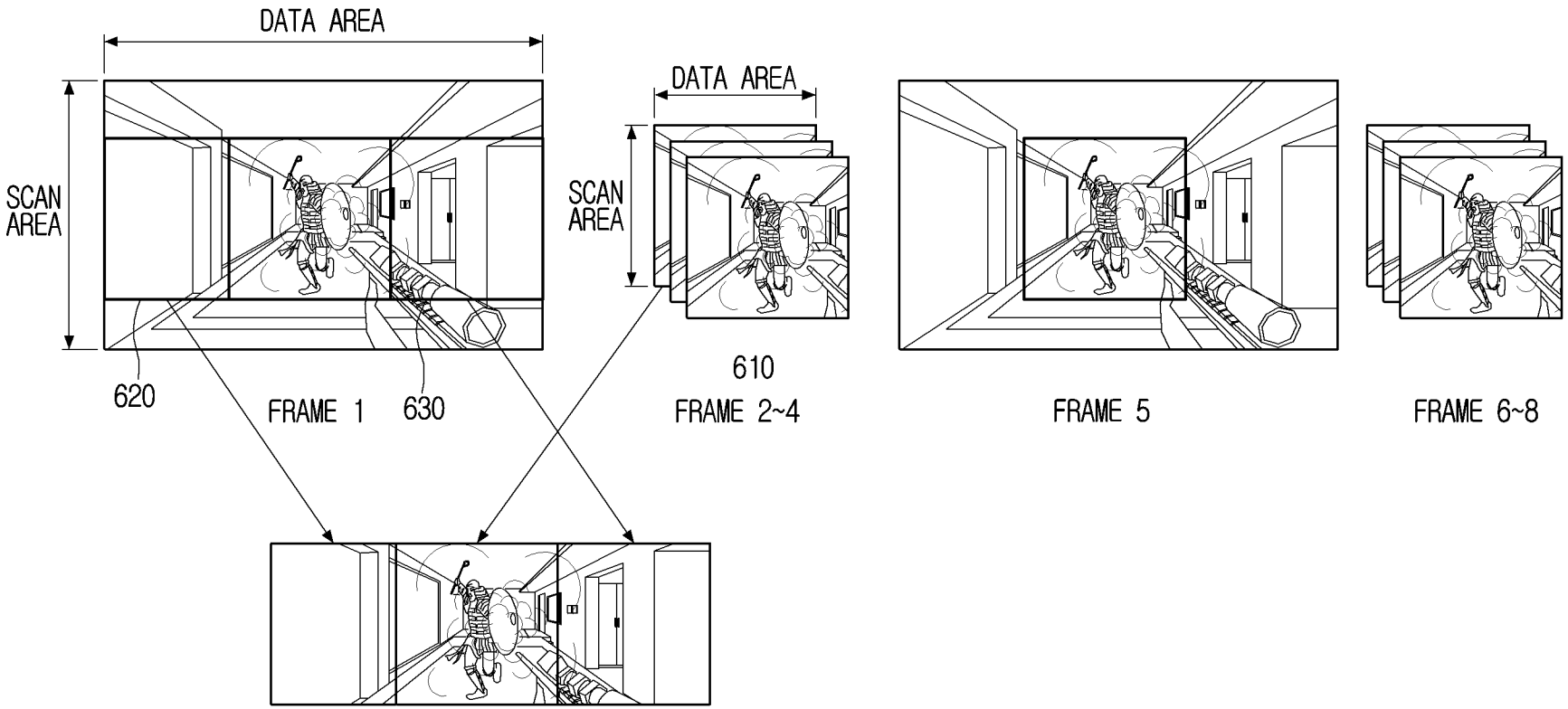
FIG. 6 is a diagram illustrating an operation of a display panel during a high-speed driving according to an example embodiment.
Figure 7:
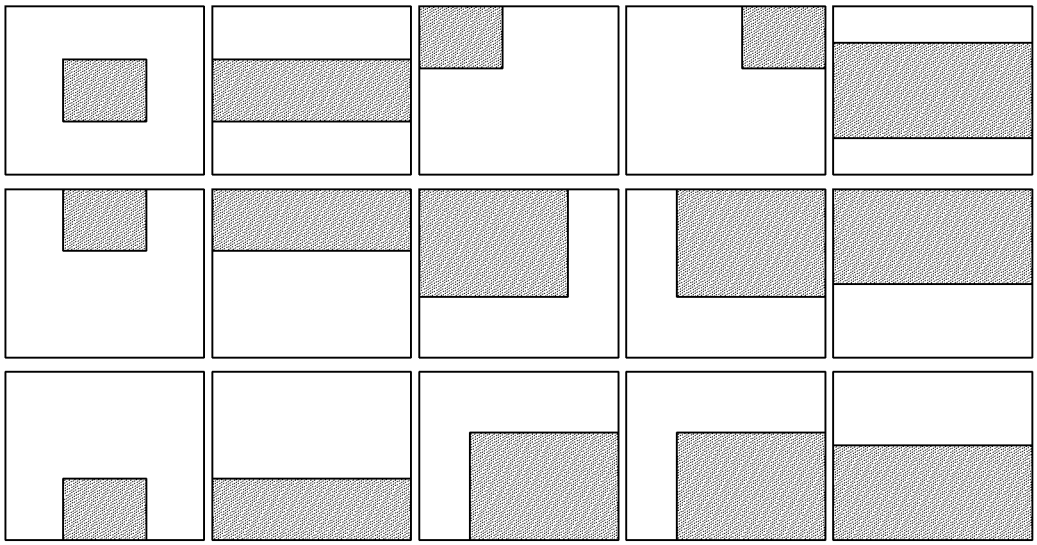
FIG. 7 is a diagram illustrating various partial areas according to an example embodiment.

Hereinafter, the operation of the display apparatus 100 will be described in more detail with reference to FIGS. 5 to 7. In FIGS. 5 to 7, individual embodiments will be described for convenience of description. However, the individual embodiments of FIGS. 5 to 7 may be practiced in a combined state in any combination thereof.

FIG. 5 is a diagram illustrating a partial area of a second frame according to an embodiment.

The processor 130 may obtain a motion value for each frame and identify the partial area of the second frame based on the motion value. For example, referring to FIG. 5, the processor 130 may identify a center area 510 having a high motion value as the partial area of the second frame. However, there is no limitation thereto, and the partial area of the second frame may be determined in any other method, e.g., designated or predetermined by the user.

The processor 130 may control the display panel 120 to output the partial area of the second frame by controlling some of the plurality of gate lines and the plurality of data lines. In this case, the processor 130 may control the display panel 120 such that, while the partial area of the second frame is output through a partial area of the display panel, an area corresponding to the first frame output before the second frame is output to another area of the display panel 120.

The processor 130 may control the display panel 120 by providing a turn-on signal to only some of the plurality of gate lines while the partial area of the second frame is output through the partial area of the display panel 120. The processor 130 may control the display panel 120 to output the partial area of the second frame by providing the image data of the second frame corresponding to the gate line, to which the turn-on signal is provided, to the plurality of data lines.

For example, the processor 130 may provide, not only the image data of the second frame corresponding to the center area 510 of FIG. 5, but also the image data of the second frame corresponding to the right and left areas of the center area 510 of FIG. 5 to the plurality of data lines. Such an operation is performed because the image is output to, not only the center area 510 of FIG. 5, but also the right and left areas, by the gate line to which the turn-on signal is provided.

In this case, if the camera angle does not change significantly, there is substantially no or little sense of difference between the area corresponding to the gate line to which the turn-on signal is provided and the other area on the display panel 120.

Alternatively, the processor 130 may provide image data of the second frame corresponding to the center area 510 of FIG. 5 and the image data of the first frame corresponding to the right and left areas of the center area 510 of FIG. 5 to the plurality of data lines, and such an operation will be described with reference to FIG. 6.

FIG. 6 is a diagram illustrating an operation of the display panel 120 during a high-speed driving according to an embodiment.

First, the processor 130 may identify at least one scene from the input image, identify a frame at a predetermined interval among frames corresponding to each of the at least one scene as a first frame, and identify the other frames, other than the identified first frame among the frames corresponding to each of the at least one scene, as second frames. The processor 130 may identify a plurality of frames in which a camera angle is fixed from the input image, identify a frame at a predetermined interval among the plurality of identified frames as the first frame, and identify the other frames, other than the identified first frame(s) among the plurality of frames, as the second frames. The processor 130 may identify an intra-frame as the first frame and identify an inter-frame as the second frames. The processor 130 may identify a frame at a predetermined interval among the plurality of frames of the input image as the first frame and identify the other frames, other than the identified first frame(s) among the plurality of frames, as the second frames.

FIG. 6 illustrates an example in which the processor 130 identifies a plurality of frames in which a camera angle is fixed from the input image, identify a frame 1 and a frame 5 among the plurality of identified frames as the first frames, and identify frames 2 to 4 and 6 to 8 as the second frames.

In other words, the processor 130 may control the display panel 120 to output the entire area of the frame 1 and the frame 5 by controlling the plurality of gate lines and the plurality of data lines, and control the display panel 120 to output the partial areas of the frames 2 to 4 and 6 to 8 by controlling some of the plurality of gate lines and the plurality of data lines.

Herein, the processor 130 may control the display panel 120 to, when a horizontal resolution of the partial area of the second frame is less than a horizontal resolution of the display panel 120, output the partial area of the first frame and the partial area of the second frame by providing a part of the image data of the first frame and a part of the image data of the second frame corresponding to the gate lines, to which the turn-on signal is provided, to the plurality of data lines.

For example, the horizontal resolution of the partial area of the frame 2 is less than the horizontal resolution of the display panel 120, and accordingly, the processor 130 may control the display panel 120 to provide a partial area 610 of the frame 2 and partial areas 620 and 630 of the frame 1 to the plurality of data lines. Through such a method, in a case of outputting the frames 3 and 4, the processor 130 may control the display panel 120 to provide the partial area of the frame 1 to the plurality of data lines, and in a case of outputting the frames 6 to 8, the processor 130 may control the display panel 120 to provide the partial area of the frame 5 to the plurality of data lines.

Accordingly, the screen of remaining area other than the partial area may be maintained in the same state in a screen area corresponding to which the turn-on signal is provided.

FIG. 7 is a diagram illustrating various partial areas according to an embodiment.

Referring to FIG. 7, the partial area may be determined in various shapes. Particularly, the partial area may be determined in various shapes as long as the vertical resolution of the partial area is less than the vertical resolution of the display panel 120 to enable the high-speed driving.

Figure 8:
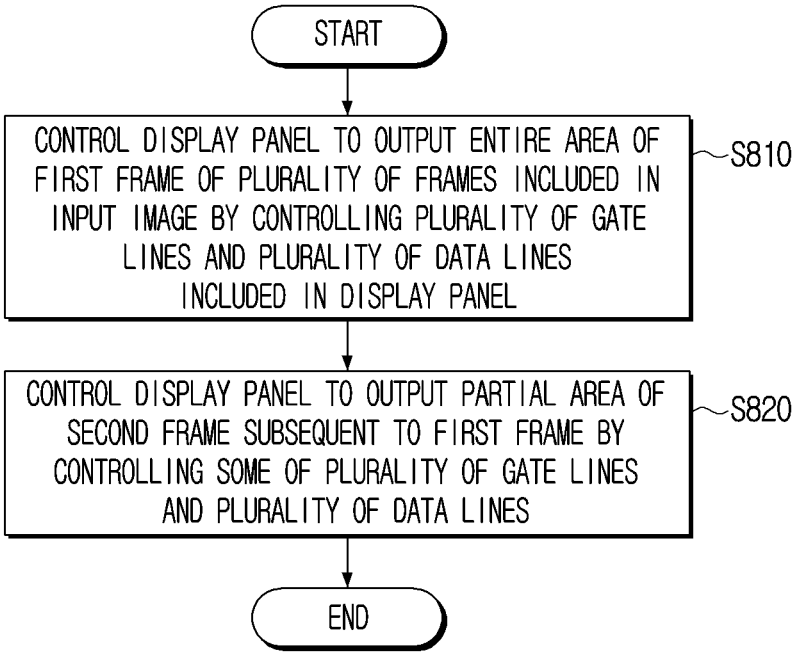
FIG. 8 is a flowchart illustrating a method for controlling the display apparatus according to an example embodiment.

FIG. 8 is a flowchart illustrating a method for controlling the display apparatus according to an embodiment.

First, a display panel may be controlled to output the entire area of a first frame of a plurality of frames included in an input image by controlling a plurality of gate lines and a plurality of data lines included in the display panel (S810). In addition, the display panel may be controlled to output a partial area of a second frame subsequent to the first frame by controlling some of the plurality of gate lines and the plurality of data lines (S820).

The controlling the display panel to output the partial area of the second frame (S820) may include controlling the display panel such that an area corresponding to the first frame is output to a remaining area of the display panel while the partial area of the second frame is output through a partial area of the display panel.

The controlling the display panel to output the partial area of the second frame (S820) may include controlling the display panel by providing a turn-on signal to only some of the plurality of gate lines while the partial area of the second frame is output through the partial area of the display panel.

The controlling the display panel to output the partial area of the second frame (S820) may include controlling the display panel to output the partial area of the second frame by providing, to the plurality of data lines, image data of the second frame corresponding to the gate line to which the turn-on signal is provided.

The controlling the display panel to output the partial area of the second frame (S820) may include, based on a horizontal resolution of the partial area of the second frame being less than a horizontal resolution of the display panel, controlling the display panel to output the partial area of the first frame and the partial area of the second frame by providing, to the plurality of data lines, a part of image data of the first frame and a part of image data of the second frame corresponding to the gate line to which the turn-on signal is provided.

The method may further include identifying at least one scene from the input image, and identifying a frame at a predetermined interval among frames corresponding to each of the at least one scene as the first frame, and identifying another frame, other than the identified first frame among the frames corresponding to each of the at least one scene, as the second frame.

The method may further include identifying the partial area of the second frame based on a motion value of each frame in each of the at least one scene.

The method may further include identifying a size of the partial area of the second frame based on the number of first frames included in each of the at least one scene.

The method may further include receiving a user command, and identifying the partial area based on the received user command.

The input image may be an image having a frame rate higher than an output frequency of the display panel.

According to various embodiments of the disclosure, the display apparatus may provide improved response characteristics to the user by rapid driving of only the partial area of the input image.

In addition, the display apparatus may be implemented to operate at an operation frequency comparatively lower than the frame rate of the input image, thereby implementing the display apparatus with low cost.

According to example embodiments of the disclosure, it is possible to more efficiently provide a smooth image by rapidly driving only an area of user's interest or an area with a motion value of a threshold value or more, compared to a case of the rapid driving of all areas.

According to an embodiment of the disclosure, various embodiments described above may be implemented as software including instructions stored in machine (e.g., computer)-readable storage media. The machine is an apparatus which invokes instructions stored in the storage medium and is operated according to the invoked instructions, and may include an electronic apparatus (e.g., an artificial intelligence electronic apparatus) according to example embodiments. In a case where the instruction is executed by a processor, the processor may perform a function corresponding to the instruction directly or using other elements under the control of the processor. The instruction may include a code made by a compiler or a code executable by an interpreter. The machine-readable storage medium may be provided in a form of a non-transitory storage medium. Here, the "non-transitory" storage medium is tangible and may not include signals, and it does not distinguish that data is semi-permanently or temporarily stored in the storage medium.

According to an embodiment of the disclosure, the methods according to various embodiments in this disclosure may be provided in a computer program product. The computer program product may be exchanged between a seller and a purchaser as a commercially available product. The computer program product may be distributed in the form of a machine-readable storage medium (e.g., compact disc read only memory (CD-ROM)) or distributed online through an application store (e.g., PlayStore™). In a case of the on-line distribution, at least a part of the computer program product may be at least temporarily stored or temporarily generated in a storage medium such as a memory of a server of a manufacturer, a server of an application store, or a relay server.

The embodiments described above may be implemented in a recording medium readable by a computer or a similar device using software, hardware, or a combination thereof. In some cases, the embodiments described in this specification may be implemented as a processor itself. According to the implementation in terms of software, the embodiments such as procedures and functions described in this specification may be implemented as separate software modules. Each of the software modules may perform one or more functions and operations described in this specification.

Computer instructions for executing processing operations according to the embodiments of the disclosure descried above may be stored in a non-transitory computer-readable medium. When the computer instructions stored in such a non-transitory computer-readable medium are executed by the processor, the computer instructions may enable a specific machine to execute the processing operations according to the embodiments described above. The non-transitory computer-readable medium is not a medium storing data for a short period of time such as a register, a cache, or a memory, but may refer to a medium that semi-permanently stores data and is readable by a machine. Specific examples of the non-transitory computer-readable medium may include a CD, a DVD, a hard disk drive, a Blu-ray disc, a USB, a memory card, and a ROM.

Each of the elements (e.g., a module or a program) according to various embodiments described above may include a single entity or a plurality of entities, and some sub-elements of the abovementioned sub-elements may be omitted or other sub-elements may be further included in various embodiments. Alternatively or additionally, some elements (e.g., modules or programs) may be integrated into one entity to perform the same or similar functions performed by each respective element prior to the integration. Operations performed by a module, a program, or other elements, in accordance with various embodiments, may be performed sequentially, in a parallel, repetitive, or heuristically manner, or at least some operations may be performed in a different order, omitted, or may add a different operation.

While example embodiments of the disclosure have been shown and described, the disclosure is not limited to the aforementioned example embodiments, and it is apparent that various modifications may be made by those having ordinary skill in the technical field to which the disclosure belongs, without departing from the gist of the disclosure as claimed by the appended claims and their equivalents. Also, it is intended that such modifications are not to be interpreted independently from the technical idea or prospect of the disclosure.

What is claimed is:

1. A display apparatus comprising:

a memory configured to store an input image;

a display panel comprising a plurality of gate lines and a plurality of data lines; and a processor configured to:

control the display panel to output an entire area of a first frame of a plurality of frames included in the input image by controlling the plurality of gate lines and the plurality of data lines; and control the display panel to output a partial area of a second frame subsequent to the first frame by controlling some of the plurality of gate lines and the plurality of data lines, an output frequency of the first frame being different from an output frequency of the second frame, wherein the processor is further configured to:

identify at least one scene from the input image; and identify a frame at a predetermined interval among frames corresponding to each of the at least one scene as the first frame and identify a remaining frame as the second frame.

2. The display apparatus according to claim 1, wherein the processor is further configured to control the display panel such that, while the partial area of the second frame is output through a partial area of the display panel, an area corresponding to the first frame is output in another area, among remaining areas other than the partial area, of the display panel.

3. The display apparatus according to claim 1, wherein the processor is further configured to control the display panel by providing a turn-on signal only to the some of the plurality of gate lines, while the partial area of the second frame is output through a partial area of the display panel.

4. The display apparatus according to claim 3, wherein the processor is configured to control the display panel to output the partial area of the second frame by providing image data of the second frame corresponding to a gate line, to which the turn-on signal is provided, to the plurality of data lines.

5. The display apparatus according to claim 4, wherein the processor is further configured to, based on a horizontal resolution of the partial area of the second frame being less than a horizontal resolution of the display panel, control the display panel to output a partial area of the first frame and the partial area of the second frame by providing, to the plurality of data lines, a part of image data of the first frame and a part of image data of the second frame corresponding to the gate line to which the turn-on signal is provided.

6. The display apparatus according to claim 1, wherein the processor is further configured to identify the partial area of the second frame based on a motion value of each frame in each of the at least one scene.

7. The display apparatus according to claim 1, wherein the processor is further configured to identify a size of the partial area of the second frame based on a number of first frames included in each of the at least one scene.

8. The display apparatus according to claim 1, further comprising:

a user interface, wherein the processor is further configured to identify the partial area of the second frame based on a user command received through the user interface.

9. The display apparatus according to claim 1, wherein the input image is an image having a frame rate higher than an output frequency of the display panel.

10. A method for controlling a display apparatus, the method comprising:

controlling a display panel to output an entire area of a first frame of a plurality of frames included in an input image by controlling a plurality of gate lines and a plurality of data lines included in the display panel; and controlling the display panel to output a partial area of a second frame subsequent to the first frame by controlling some of the plurality of gate lines and the plurality of data lines, an output frequency of the first frame being different from an output frequency of the second frame, wherein the method further comprises:

identifying at least one scene from the input image; and identifying a frame at a predetermined interval among frames corresponding to each of the at least one scene as the first frame and identifying a remaining frame as the second frame.

11. The method according to claim 10, wherein the controlling the display panel to output the partial area of the second frame comprises controlling the display panel such that, while the partial area of the second frame is output through a partial area of the display panel, an area corresponding to the first frame is output in another area, among remaining areas other than the partial area, of the display panel.

12. The method according to claim 10, wherein the controlling the display panel to output the partial area of the second frame comprises controlling the display panel by providing a turn-on signal only to the some of the plurality of gate lines, while the partial area of the second frame is output through a partial area of the display panel.

13. The method according to claim 12, wherein the controlling the display panel to output the partial area of the second frame comprises controlling the display panel to output the partial area of the second frame by providing, to the plurality of data lines, image data of the second frame corresponding to a gate line to which the turn-on signal is provided.

14. The method according to claim 13, wherein the controlling the display panel to output the partial area of the second frame comprises, based on a horizontal resolution of the partial area of the second frame being less than a horizontal resolution of the display panel, controlling the display panel to output a partial area of the first frame and the partial area of the second frame by providing, to the plurality of data lines, a part of image data of the first frame and a part of image data of the second frame corresponding to the gate line to which the turn-on signal is provided.

* * * * *